United States Patent [19]

Bäuerle

[11] 4,265,630

[45] May 5, 1981

[54] THERMOTRANSFER PROCESS FOR PRINTING SYNTHETIC FIBRE MATERIALS WITH MULTI-COLOR EFFECTS, AND CARRIER FOR PERFORMING THE PROCESS

[75] Inventor: Rolf Bäuerle, Riehen, Switzerland

[73] Assignee: Ciba-Geigy Aktiengesellschaft, Basel, Switzerland

[21] Appl. No.: 92,780

[22] Filed: Nov. 8, 1979

[30] Foreign Application Priority Data

Nov. 17, 1978 [CH] Switzerland ..... 11830/78

[51] Int. Cl.[3] ..... D06P 5/12

[52] U.S. Cl. ..... 8/456; 8/471; 106/22

[58] Field of Search ..... 8/2.5 A, 456, 471

[56] References Cited

U.S. PATENT DOCUMENTS

| | | | |
|---|---|---|---|
| 3,813,218 | 5/1974 | de Plasse | 8/2.5 |
| 4,171,202 | 10/1979 | Sideman et al. | 8/2.5 A |

FOREIGN PATENT DOCUMENTS

| | | |
|---|---|---|
| 2755730 | 6/1978 | Fed. Rep. of Germany . |
| 2758398 | 7/1978 | Fed. Rep. of Germany . |
| 50/55412 | 5/1975 | Japan . |
| 569141 | 11/1975 | Switzerland . |
| 1243223 | 8/1971 | United Kingdom . |

*Primary Examiner*—A. Lionel Clingman

*Attorney, Agent, or Firm*—Sprung, Felfe, Horn, Lynch & Kramer

[57] ABSTRACT

A thermal dry transfer-printing process for printing synthetic fibre materials with multi-color effects, wherein there is used an intermediate carrier which is printed:

(1) in places with at least one reserve printing paste or ink, and (2) with a printing paste or ink for printing the base (ground).

The reserve paste or ink (1) contains at least:

(a) one solvent, (b) one thickener, (c) optionally one non-reservable, sublimable disperse dye, (d) optionally one curing catalyst, and (e) one organic solvent and/or water.

The printing paste or ink (2) for printing the base contains at least:

(b) one thickener, (g) one reservable, sublimable disperse dye, (e) one organic solvent and/or water, and (f) optionally one binder.

The printed intermediate carrier is fast to rubbing and is storage-stable. It is brought into contact with the fibre materials, and both are subjected to a heat treatment at elevated temperature until the non-reservable dyes are transferred from the carrier to the fibre material. There are obtained on the fibre material any desired number of patterns in the widest variety of colors and shades, the patterns having extremely sharp contours and being without aureoles.

14 Claims, No Drawings

THERMOTRANSFER PROCESS FOR PRINTING SYNTHETIC FIBRE MATERIALS WITH MULTI-COLOR EFFECTS, AND CARRIER FOR PERFORMING THE PROCESS

The present invention relates to a thermal dry transfer printing process for printing synthetic fibre materials with multi-colour effects, in which process an intermediate carrier is printed, in any chosen sequence, (1) in places with at least one reserve printing paste or reserve printing ink, and (2) with a printing paste or printing ink for printing the base, the reserve printing paste or ink (1) containing at least:

(a) one reserving agent,
(b) one thickener,
(c) optionally one non-reservable, sublimable disperse dye,
(d) optionally one curing catalyst and
(e) one organic solvent and/or water; and the printing paste or ink (2) for printing the base containing at least:
(b) one thickener,
(g) one reservable, sublimable disperse dye,
(e) one organic solvent and/or water and
(f) optionally one binder;

the intermediate carrier is dried; brought into contact with the fibre material to be printed, and both are subjected to a heat treatment at elevated temperature, optionally with the application of pressure, until the unreserved dyes are transferred from the intermediate carrier to the fibre material, and the intermediate carrier is then separated from the printed fibre material. The intermediate carrier for performing the process, which carrier is printed in places with at least one reserve printing paste or ink (1) and with a printing paste or ink for dyeing the base (2), of the given compositions, and the fibre materials printed by the process form further subject matter of the present invention.

The reserve printing pastes or inks (1) [known also as resist printing pastes or inks] contain as a rule: 10 to 25% of a reserving agent (b) [known also as resisting agent], 0.2 to 15%, preferably 0.5 to 10%, of a thickener (b), 0 to 10% of a non-reservable dye (c), 0 to 2.5, preferably 0 to 1% of a curing catalyst (d), and 50 to 90% of water and/or of an organic solvent (e); and the printing pastes or inks (2) for printing the base: 0.2 to 15%, preferably 0.5 to 10%, of a thickener (b), 40 to 98% of water and/or of an organic solvent (e), 0 to 5% of a binder (f), and 1 to 20%, preferably 2 to 10%, of a reservable dye (g).

The percentages given for the constituents (a), (b), (c), (g), (d) and (f) relate to pure (i.e. 100%) reserving agents, thickeners, dyes, curing catalysts and binders; and all percentage values are percent by weight, the sum of the weight percentages for the various printing pastes or printing inks always adding up to hundred percent by weight.

In general, both the reserve printing pastes or inks (1) and the printing pastes or inks (2) for printing the base are applied to the intermediate carriers, depending on the type and nature of the intermediate carriers, in such a way that the amount deposited on the surface of the intermediate carrier is about 8 to 25 g/m$^2$.

The reserving agents (a) used are preferably highly etherified aminoplast pre-condensates, that is to say, highly etherified addition products of formaldehyde or of formaldehyde-forming agents, for example paraformaldehyde, hexamethylenetetramine or trioxane, with N-methylolatable nitrogen compounds. These aminoplast pre-condensates are present on the intermediate carrier in at least a partially cured or crosslinked condition, that is to say, as aminoplast resins.

Methylolatable nitrogen compounds which may be mentioned are 1,3,5-aminotriazines such as N-substituted melamines, for example butylmelamine, N-trihalomethylmalamines, triazones, as well as guanamines, for example benzoguanamines, acetoguanamines and diguanamines. Also suitable are: cyanamide, acrylamide, alkyl- or arylureas and -thioureas, alkyleneureas or -diureas, for example urea, thiourea, urons, ethyleneurea, propyleneurea, acetylenediurea or 4,5-dihydroxyimidazolidone-2 and derivatives thereof, for example 4,5-dihydroxyimidazolidone-2 substituted in the 4-position on the hydroxyl group with the radical —$CH_2$—$CH_2$—CO—NH—$CH_2OH$, and carbamates of lower alkanols, such as carbamic acid-methyl, -ethyl or -hydroxyethyl esters. Preferred among these nitrogen compounds which can be methylolated are urea and, in particular, melamine.

Accordingly, preferred etherified aminoplasts are in particular etherified aminoplast formers, for example etherified dimethylolurea, dimethylolethyleneurea, dimethylolpropyleneurea, etherified, optionally partially methoxylated dimethyloldihydroxy-ethyleneurea, etherified dimethyloluron, trimethylolmelamine, trimethoxymethylmelamine, pentamethylolmelamine, hexamethylolmelamine, hexamethoxymethylmelamine, dimethylolmethyltriazine, dimethylolhydroxyethyltriazone, dimethylolhydroxyethyltriazone, dimethylolmethylcarbamate and 4-methoxy-5-dimethyldimethylolpropyleneurea, with etherified dimethylolurea, dimethyleneethyleneurea, particularly etherified pentamethylolmelamine and hexamethylolmelamine being especially preferred.

Both predominantly etherified monomolecular and etherified higher precondensed aminoplasts are suitable as aminopolast pre-condensates.

The reserving agents (a) employed are preferably water-soluble ethers of the aforementioned aminoplast pre-condensates with alkanols having 1 to 4 carbon atoms, such as ethanol, n-propanol, isopropanol, n-butanol or in particular methanol. Of major interest as reserving agents (a) are hence pentamethylolmelaminetetramethyl ether and especially hexamethylolmelaminehexamethyl ether; as a commercial product, hexamethylolmelaminehexamethyl ether is not completely etherified but is a hexamethylolmelamine highly etherified up to 90 to 98% with methanol.

Suitable as component (b) are essentially all thickeners customarily used in textile printing, of both natural and synthetic origin. Examples of such thickeners which may be mentioned are: alginates, optionally etherified best grade flour, etherified cellulose or starch and homo- or copolymers based on acrylic acid or maleic anhydride. Preferred natural thickeners (b) for aqueous printing pastes (1) or (2) are in particular sodium alginate, an etherified potato starch or an etherified guar or locust bean flour; and preferred thickeners (b) for solvent-containing printing inks (1) or (2) are especially cellulose ethers or cellulose esters, for example hydroxyethylcellulose, cellulose acetobutyrate, preferably hydroxypropylcellulose, cellulose acetopropionate and, in particular, ethylcellulose and carboxymethylcellulose.

Preferred synthetic thickeners (b) for aqueous printing pastes (1) or (2) are especially copolymers based on ethylene/maleic anhydride; and preferred synthetic thickeners (b) for solvent-containing printing inks (1) or (2) are particularly homopolymers of acrylic acid or of acrylic acid amide, copolymers of acrylic acid or of acrylic acid amide, or copolymers of acrylic acid and of acrylates.

The thickeners used as component (b) are as a rule prepared as aqueous solutions having a 1 to 15, preferably 2 to 8, percent by weight content of ingredients. They can also be constituents of formulations of the dyes (c) and (g).

The dyes used as components (c) and (g) in printing pastes or inks (1) and (2) are the customary sublimable disperse dyes suitable for the thermotransfer printing process, which convert at 160° to 220° C. into the vapour state, that is to say, dyes of which the vapour pressure at, for example, 200° C. is higher than $10^{-5}$ bar.

The sublimable disperse dye used as component (g) in the printing paste or ink (2) for printing the base of the intermediate carrier is reservable (resistible), that is, it reacts at the temperatures used in the transfer printing process with the component (a) in the reserve printing paste or ink (1). The result of this is that this reservable dye, in the thermotransfer printing process, is not transferred to the fibre material at the places where the intermediate carrier is provided with a reserving agent. The obtainment of patterned reprints is rendered possible by virtue of this reserving of the dye.

The sublimable disperse dye optionally used as component (c) in the reserve printing paste or ink (1) is not reservable, that is to say, it is inert to the reserving agent used as component (a), so that the dye can be transferred unhindered from the intermediate carrier to the fibre material. If the reserve printing paste or ink (1) contains no component (c), there are obtained so-called white resists, for example white to faintly coloured patterns on a dyed background. With the presence of non-reservable dyes (c) in the reserve printing paste or ink (1), there are on the other hand obtained so-called colour resists. When for example a yellow dye is used as component (c) in the reserve printing paste or ink (1) and a reservable blue dye as component (g) is used in the printing paste or ink (2) for printing the base (ground), yellow patterns on a blue background are obtained. With use of a single reserve printing paste or ink (1), two-colour effects are obtained, and with use of several reserve printing pastes or inks (1), multi-colour effects are obtained.

By the terms reservable and non-reservable dyes (c) and (g) are meant within the scope of this invention only those dyes which, with the given amount of reserving agent (a) and optionally of dye (c) in the reserve printing paste or ink (1), and also of dye (g) in the printing paste or ink (2), with the given deposited amount of the printing pastes or inks (1) and (2), with chemical reaction of the dyes (g) with the reserving agent (a), and optionally with the absence of a chemical reaction of the dyes (c) with the reserving agent (a), exhibit the behaviour described in the foregoing. The process according to the invention thus differs from known processes in which, for example, a resin or a so-called blocking agent is applied in any desired depth of deposit, that is to say, in any desired thickness of coating, in given areas over the paste or ink for printing the base, so that at the places at which the blocking agent has been applied, the dye is prevented, particularly on account of physical processes, from being transferred from the intermediate carrier to the fibre material to be printed. In the case of known processes of this type, the patterns obtained are frequently not entirely uniform, and they often have contours which are poorly defined or aureoles.

The dyes (c) and (g) used in the printing pastes (1) and (2) belong, inter alia, to the groups comprising nitro dyes of the aniline series, azo dyes of the benzene series, as well as anthraquinone, quinoline, pyrazolone, triazole, pyridone or styryl dyes, and are described, for example, in Colour Index, 3rd Edition, 1971, under the heading "Disperse dyes", in the Belgian Pat. No. 584,558; in the British Pat. Nos. 959,314, 1,189,026, 1,127,721, 1,211,149, 1,254,021, 1,344,353, 1,359,206, 1,334,114, 1,445,201 and 1,460,742; in the German Offenlegungsschriften Nos. 2,739,174 and 2,739,314; and in the journal "Man-made Textiles in India", pages 40–43, January 1977.

The non-reservable, sublimable disperse dyes used as component (c) in the reserve printing paste or ink (1) contain as a rule no amino or hydroxyl groups capable of reacting with the component (a) at 160° to 220° C., optionally however a hydroxyl group, secondary amino group or primary amino group, each of which is bound on an aromatic nucleus and is inert to the component (a), the hydroxyl group having to be capable of forming with adjacent carbonyl, azo or nitro groups a hydrogen bridge, and the primary amino group having to be sterically hindered by a substituent in the o-position.

Disperse dyes of the following formulae may be mentioned as examples of non-reservable disperse dyes of the aforementioned type:

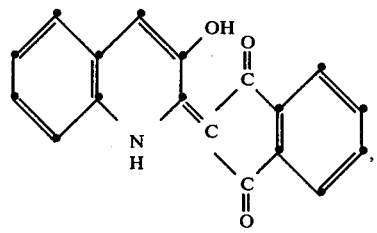

(1)

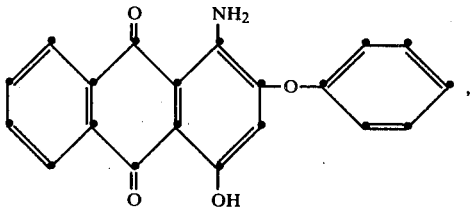

(2)

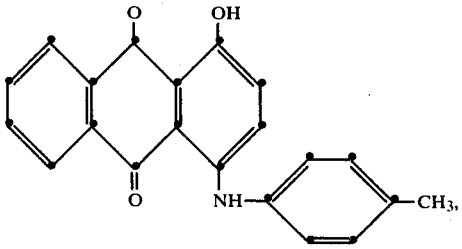

(3)

-continued (4)

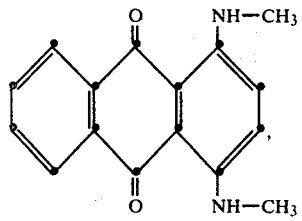

(5)

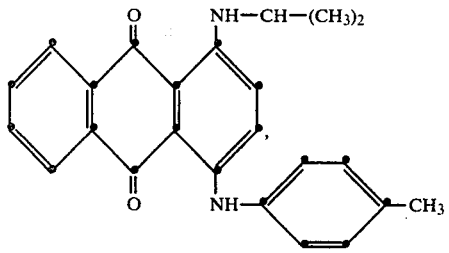

(6)

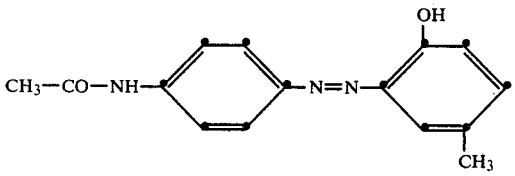

and (7)

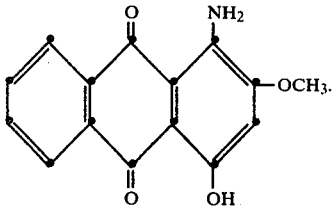

The reservable, sublimable disperse dyes used as component (g) in the printing paste or ink (2) contain as a rule at least one amino or hydroxyl group capable of reacting with the component (a) at 160° to 220° C. The reactive amino or hydroxyl group is preferably a hydroxyl or amino group bound on an aliphatic chain, a hydroxyl or primary amino group bound on an aromatic nucleus, or a secondary amino group present as member of a pyrazolone, triazole or pyridone ring, the hydroxyl group being free from adjacent carbonyl, azo or nitro groups, and the primary amino group from substituents in the o-position.

It can be determined by simple tests with preferably dye-free reserve printing pastes or inks (1) whether or not a given sublimable disperse dye of the printing paste or ink (2) is reservable, that is to say, capable of reacting with the reserve printing paste or ink (1), and hence no longer transferable from the intermediate carrier to the fibre material.

Disperse dyes of the following formulae may be mentioned as examples of reservable dyes of the above type:

(8)

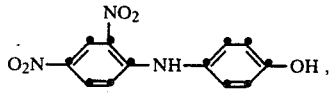

(9)

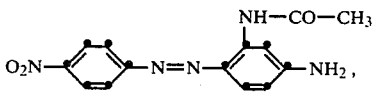

-continued (10)

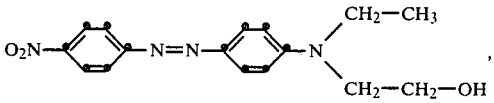

(11)

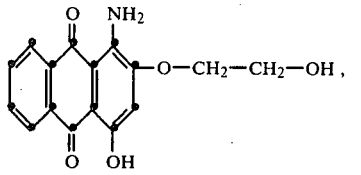

(12)

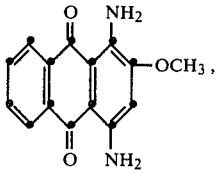

(13)

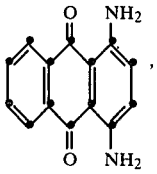

(14)

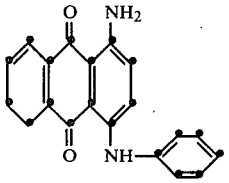

(15)

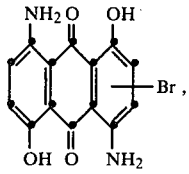

(16)

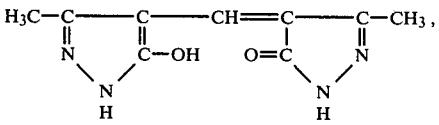

(17)

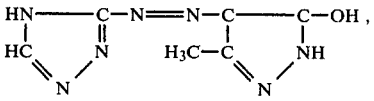

(18)

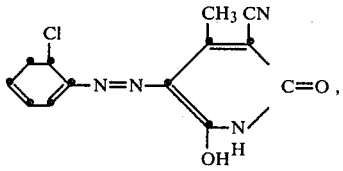

(19)

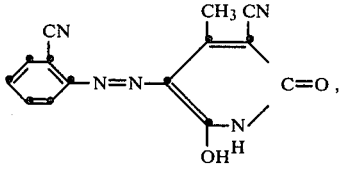

(20)

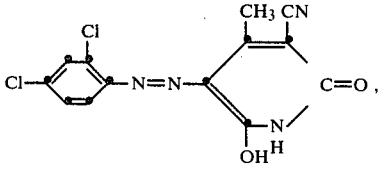

-continued (21)

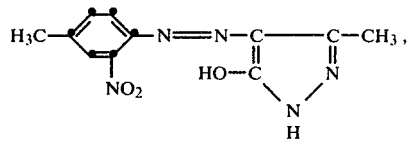

(22)

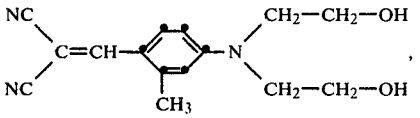

(23)

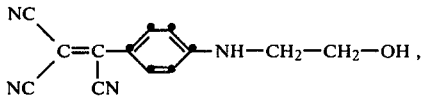

(24)

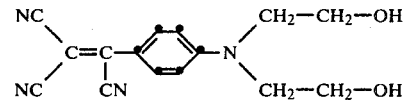

and (25)

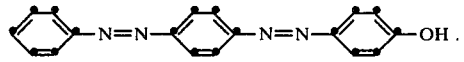

The dyes used as components (c) and (g) are as a rule commercial 30 to 60 percent by weight formulations. When aqueous printing pastes (1) and (2) are used for the reserve and for printing the base (or ground), the formulations contain, in addition to water, generally dispersing agents, for example lignin sulfonates, fatty alcohol polyglycol ethers, aromatic sulfonic acids, for instance naphthalenesulfonic acids or condensation products thereof with formaldehyde, one of the aforementioned thickening agents, as well as preferably further auxiliaries, such as wetting agents, for example fatty acid alkanolamides, ethyleneoxy adducts from fatty alcohols or fatty amines, antifreeze agents and agents maintaining the product moist, for example ethylene glycol, propylene glycol, glycerol or sorbitol, preserving agents, for example hexamethylenetetramine-chlorallyl derivatives, defoaming agents, for example silicone oil emulsions and, if the employed dyes are in pulverulent form, anti-dust agents, for example a sulfonated mineral oil.

When printing inks (1) and (2) containing solvents are used for the reserve and for printing the base, the formulations contain as solvents for example an aliphatic alcohol or ketone, or an aromatic hydrocarbon having in each case at most 8 carbon atoms, preferably an alkanol having 1 to 4 carbon atoms. The following may be mentioned as examples of solvents of this type: chlorobenzene, toluene, xylene, benzene and methyl ethyl ketone, preferably however propanol, methanol and in particular ethanol and isopropanol. These printing inks as a rule contain, besides the solvent, preferably only one of the above-mentioned thickeners as auxiliary, especially a cellulose ether or ester, for example hydroxyethylcellulose or cellulose acetopropionate or in particular ethylcellulose.

The curing catalysts used as component (d) are, inter alia: acid or potentially acid catalysts, for example citric acid, tartaric acid, phosphoric acid, ammonium chloride, zinc chloride, zinc nitrate, preferably magnesium chloride or in particular 2-amino-2-methyl-1-propanol hydrochloride. Also sulfates and phosphates of aminomethylpropanol are suitable.

The optional component (d) acts as a curing catalyst for the component (a) used as reserving agent. The concomitant use of an acid catalyst as component (d) is necessary only where natural thickeners are employed as component (b), which in general are neutral to alkaline. If alternatively synthetic thickeners are used, which produce an acid reaction under the transfer conditions, that is, at elevated temperatures, it is not necessary to concomitantly use an acid catalyst for curing the reserving agent. The curing catalyst used as component (d) is usually in the form of a 20 to 30 percent by weight aqueous solution.

In the case of the solvents used as component (e) in the printing inks (1) or (2) for the reserve printing or for printing the base, these are preferably the same solvents as those already mentioned with regard to the solvent-containing dye formulations.

The binders optionally used as component (f) only in the printing pastes or inks (2) for printing the base are preferably homopolymers of the vinyl series, for example polyvinyl alcohol or polyvinyl acetate. Polymers of this type are usually in the form of 10 to 30 percent by weight aqueous solutions.

Preferred reserve printing inks (1) contain: 10 to 25% of a highly etherified aminoplast pre-condensate as reserving agent (a), 0.5 to 15%, preferably 4 to 10% and particularly 0.5 to 15%, of a cellulose ester or ether as natural thickener (b), 0 to 10% or 2 to 10%, as component (c), of a non-reservable disperse dye which, as already mentioned, is inert to the component (a), 0.3 to 2.5%, especially 0.3 to 1%, of magnesium chloride or 2-amino-2-methyl-1-propanol hydrochloride as curing catalyst (d), 50 to 90% of an aliphatic alcohol or ketone or of an aromatic hydrocarbon having in each case at most 8 carbon atoms, as solvent (e), and 0 to 20%, or 5 to 20% of water.

Preferred reserve printing pastes (1) contain either 10 to 25% of a highly etherified aminoplast pre-condensate as reserving agent (a), 2 to 10% of a sodium alginate, of an etherified starch or of an etherified high grade flour, as natural thickener (b), 0 to 10%, or 2 to 10%, as component (c), of a non-reservable disperse dye which, as already mentioned, is inert to the component (a), 0.3 to 2.5%, particularly 0.5 to 1.5%, of magnesium chloride or 2-amino-2-methyl-1-propanol hydrochloride as curing catalyst (d), and 50 to 90% of water; or 10 to 25% of a highly etherified aminoplast pre-condensate as reserving agent (a), 0.2 to 2%, particularly 0.5 to 2%, of a mono- or copolymer of acrylic acid or of acrylates or of a copolymer based on ethylene/maleic anhydride, as synthetic thickener (b), 0 to 10%, or 2 to 10%, as component (c), of a disperse dye which, as already mentioned, is inert to component (a), and 40 to 90% of water.

Preferred printing inks (2) for printing the base contain: 0.5 to 15%, preferably 4 to 10%, and especially 0.5 to 1.5%, of a cellulose ester or ether, as thickener (b), 40 to 95% of an aliphatic alcohol or ketone or of an aromatic hydrocarbon having in each case at most 8 carbon atoms, as solvent (e), 2 to 20%, particularly 2 to 10%, of a reservable dye (g) of the given type, 0 to 5%, or 3 to 5%, of a polyvinyl alcohol or polyvinyl acetate, as binder (f), and 0 to 20% of water; and preferred printing pastes (2) for printing the base contain: 0.2 to 10%, particularly 5 to 10%, of an alginate, of an optionally etherified high grade flour, of an etherified cellulose or starch, or of a homo- or copolymer based on acrylic acid, acrylic acid amide or maleic anhydride, as thickener (b), 2 to 20%, especially 2 to 10%, of a reservable dye (g) of the given type, 0 to 5%, or 3 to 5%, of a polyvinyl alcohol or polyvinyl acetate, as binder (f), and 25 to 98% of water.

The printing pastes are in general preferred to the printing inks.

Suitable fibre materials which can be printed according to the invention are in particular fibre materials in the form of broad widths of fabric, for example carpets, fleeces, preferably knitted goods and especially fabrics. The synthetic fibres concerned are particularly cellulose acetate fibres, for example cellulose 2½-acetate and preferably cellulose triacetate, and fully synthetic fibres made from, inter alia, acrylonitrile homopolymers or acrylonitrile copolymers, also called modacrylic fibres, in which advantageously the acrylonitrile proportion is at least 50 percent by weight of the copolymer, and in which usually other vinyl compounds are used as comonomers; preferably polyamide fibres, for example those formed from poly-2-caprolactam, polyhexamethylenediamine-adipate or poly-ω-aminoundecanoic acid; or modified polyamide fibres, for example those from polycarboxylic acid amides from bis-(p-aminocyclohexyl)-methane and decanedicarboxylic acid; and especially polyester fibres, for example those which are derived from terephthalic acid, such as for instance poly(ethylene glycol terephthalate) or poly(1,4-cyclohexyldimethylene terephthalate). Polyester materials are particularly well suited to be printed by the process according to the invention. Also mixtures of the fibre materials mentioned are suitable.

Suitable for printing cellulose acetate fibres and modified polyamide fibers of the type mentioned in the foregoing are in particular the non-reservable dyes of the formulae (1) to (5) and the reservable dyes of the formulae (8) to (15) and (21); suitable for printing polyacrylonitrile fibres are particularly the non-reservable dyes of the formulae (1), (4), (6) and (7) and the reservable dyes of the formulae (8), (9), (11) to (15) and (21); suitable for printing polyamide fibres are especially the non-reservable dyes of the formulae (1) to (7) and the reservable dyes of the formulae (9), (14), (15), (21) and (25); and suitable for printing polyester fibres are especially the non-reservable dyes of the formulae (1) to (5) and the reservable dyes of the formulae (8) to (15) and (21). Thus the non-reservable dyes (1) to (7) and the reservable dyes of the formulae (8) to (15), (21) and (25) are preferred to the reservable dyes (16) to (20) and (22) to (24).

It is possible with an advantageous combination of these preferred dyes to obtain virtually all conceivable colours or shades of the visible spectrum.

The widest variety of printing techniques are used for printing the intermediate carrier, such as the flat printing process (for example offset), the electrostatic printing process, screen printing (for example flat screen printing, rotary flat printing and silk screen printing), the high pressure process (for example book printing, flexographic and relief printing) and especially the gravure printing process (for example roller printing) and the rotary printing process (for example discharge printing and deep engraving printing).

The viscosity of the printing inks and pastes (1) and (2) has to be adjusted to suit the particular printing technique used, an adjustment which is effected by varying the amount of thickener (b) in the printing inks or pastes. This applies also to the amount of printing ink or pastes (1) and (2) applied to the intermediate carrier. The deposit per unit area in the screen printing process (rotary flat printing) is for example preferably 15 to 20 g/m$^2$, and in the gravure printing process it is for example 8 to 12 g/m$^2$.

The reserving effect of component (a) in the reserve printing paste or ink is independent of the sequence in which the printing inks or pastes (1) and (2) are applied to the intermediate carrier. If however the reserve printing pastes or inks (1) are applied first and then the printing pastes or inks (2) for printing the base, there is no need for the otherwise expedient markings of the areas printed with the paste or ink (1) with suitable agents, for example with non-transferable dyes or fluorescent substances, which would render the process according to the invention difficult.

Whereas the printing with the reserve printing paste or ink (1) is always performed in places or on specific areas, the paste or ink (2) for printing the base or background is preferably printed over the whole surface. A so-called intermediate drying is optionally performed between printing with the reserve printing paste or ink (1) and printing with the paste or ink (2) for printing the base. Preferably, however, the intermediate carrier is printed without intermediate drying in one single operation. The intermediate carrier is dried after printing with the two pastes or inks (1) and (2). This drying and any intermediate drying are preferably performed at 80° to 140° C.

The intermediate carriers printed according to the invention have the advantage that they can be produced in a single economical operation. They are fast to rubbing and are able to be stored, and can be used at any time for printing the fibre materials. For printing the fibre materials, the intermediate carrier is brought into contact with the fibre material, and both are then subjected, for example in an ironing press or calender with application of pressure, to a heat treatment, preferably at 190° to 220° C., for 20 to 90 seconds. It is also possible however to apply a vacuum, in the manner described for example in the British Patent Specification No. 1,312,529.

The essential advantage of the process according to the invention is that multi-colour effects are obtained on the fibre materials in one single and economical operation, the patterns produced being as numerous and fine as desired and having the widest variety of shades and extemely sharp outlines without the slightest sign of aureoles.

Parts and percentages given in the following Examples are in all cases in weight units.

EXAMPLE 1

An intermediate carrier made of paper is printed by the rotary printing process using the following printing pastes with a surface application in each case of 15–20 g/m$^2$:

(A) reserve printing paste consisting of 450 to 500 parts of a copolymer based on ethylene/maleic anhydride (2%) as thickener; 100 to 200 parts of hexamethylolmelaminehexamethyl ether as reserving agent; and 50 parts of the yellow dye of the formula (1) (48%): paste made up with water to 1000 parts;

(B) reserve printing paste containing the same amounts of the thickener and reserving agent of reserve printing paste (A), but with 100 parts of the red dye of the formula (2) (54%);

(C) reserve printing paste containing the same amounts of the thickener and reserving agent employed in reserve printing paste (A), but containing a mixture of 50 parts of the yellow dye of the formula (1) (48%) and 10 parts of the blue dye of the formula (4) (48%);

(D) reserve printing paste containing the same amounts of the thickener and reserving agent employed in reserve paste (A), but containing no dye;

(E) printing paste for printing the base, consisting of 450 to 500 parts of a mixture of 50% of an etherified potato starch and 50% of an etherified locust bean flour (8%) as thickener, 150 parts of a mixture of 87% of polyvinyl alcohol and 13% of polyvinyl acetate (20%) as binder, and a mixture of 20 parts of the orange-coloured dye of the formula (9) (43%) and 80 parts of the blue dye of the formula (14) (44%): paste made up with water to 1000 parts.

The pastes (A), (B), (C) and (D) are applied in places, and the paste (E) over the whole surface, the pastes (A) to (D) being applied first and the paste (E) last.

The printed intermediate carrier is dried at 100° C. for 5–10 seconds. It is stable in storage, fast to rubbing and usable at any point of time for printing synthetic fibre materials by the thermal dry transfer printing process.

For printing the fibre material, the intermediate carrier and a polyester fabric having a weight per unit area of 100 g/m$^2$ are pressed together in an ironing press for 30 seconds at 210° C. under an excess pressure of 0.04 to 0.06 bar. After transfer of the non-reserved dye from the intermediate carrier to the polyester fabric, there are obtained on the fabric yellow, mauve, green and light-blue patterns having sharp contours, without aureoles, on a violet background (base).

Identical results are obtained by using firstly the paste (E) and secondly the pastes (A) to (D); or when the pastes are used, in any sequence, in the gravure printing process with only 150 to 250 parts of the respective thickeners given for printing pastes (A) to (E).

EXAMPLE 2

The procedure is carried out in the manner described in Example 1 but using as thickener in the printing pastes (A), (B), (C) and (D) 600 parts of a mixture of 50% of an etherified potato starch and 50% of an etherified locust bean flour (8%) together with 15 parts of 2-amino-2-methyl-1-propanol hydrochloride (36%) as acid curing catalyst; and as dye in the printing paste (E) a mixture of 80 parts of the yellow dye of the formula (8) (50%), 40 parts of the orange-coloured dye of the formula (9) (43%) and 140 parts of the blue dye of the formula (14) (44%).

The intermediate carrier obtained is, as in Example 1, likewise storage stable and fast to rubbing. On application of this carrier, there are obtained on polyester fabric yellow, mauve, green and light-blue patterns having sharp contours, without aureoles, on a black background.

EXAMPLE 3

The procedure is carried out in the manner described in Example 1 but using as thickener in the printing pastes (A), (B), (C) and (D) 450 parts of sodium alginate (10%), together with 15 parts of 2-amino-2-methyl-1-propanol hydrochloride (36%) as acid curing catalyst, and as dye in the printing paste (E) a mixture of 70 parts of the yellow dye of the formula (8) (50%) and 30 parts of the blue dye of the formula (14) (44%).

The intermediate carrier obtained is, as in Example 1, likewise storage stable and fast to rubbing. On application of the carrier, there are obtained on the polyester fabric golden yellow, light-yellow, red and light-green patterns having sharp contours, without aureoles, on a dark-green background.

EXAMPLES 4 TO 33

The procedure is carried out in the manner described in Example 1 but using in places a single reserve printing paste containing one of the thickeners given in the Examples 1 to 3, optionally together with aminomethylpropanol hydrochloride as catalyst, in all cases hexamethylolmelamine-hexamethyl as reserving agent, and a dye or a dye mixture according to the following Table I; and then using over the whole surface a printing paste for printing the base, which paste contains the thickener and binder given in Example 1 for the printing paste (E), and a dye or a dye mixture according to the following Table I.

There are likewise obtained intermediate carriers which are storage stable and fast to rubbing, as given in Example 1; and on application of these carriers, there are obtained on polyester fabric the patterns listed in the following Table I, which have sharp contours without aureoles.

TABLE I

| | Dye in reserve printing paste (application in places) | | | | | Dye in the printing paste for printing the base (application to whole surface) | | | | | Patterns obtained | |
|---|---|---|---|---|---|---|---|---|---|---|---|---|
| Example No. | amount parts | formula | content % | colour | | amount parts | formula | content % | colour | | colour of the pattern | colour of the base |
| 4 | 100 | (2) | 54 | red | | 60 | (9) | 43 | orange | | dark red | orange |
| 5 | 50 | (1) | 48 | yellow | G* | 50 | (9) | 43 | orange | G* | dark green | light red |
| | 50 | (4) | 48 | blue | | 50 | (11) | 33 | pink | | | |
| 6 | 50 | (1) | 48 | yellow | G* | 40 | (9) | 43 | orange | G* | orange | dark red |
| | 40 | (2) | 54 | red | | 40 | (12) | 41 | red | | | |
| 7 | 50 | (1) | 48 | yellow | G* | 40 | (9) | 43 | orange | G* | light green | claret |
| | 10 | (4) | 48 | blue | | 40 | (10) | 45 | ruby | | | |
| 8 | 50 | (3) | 40 | blue | | 60 | (10) | 45 | ruby | | blue | ruby |
| 9 | 50 | (1) | 48 | yellow | G* | 80 | (11) | 33 | pink | | green | pink |
| | 15 | (4) | 48 | blue | | | | | | | | |
| 10 | 50 | (3) | 40 | blue | | 50 | (11) | 33 | pink | G* | blue | dark red |
| | | | | | | 50 | (12) | 41 | red | | | |
| 11 | 40 | (1) | 48 | yellow | | 80 | (12) | 45 | red | | yellow | dark red |
| 12 | 100 | (2) | 54 | red | | 60 | (13) | 42 | violet | | red | violet |
| 13 | 50 | (1) | 48 | yellow | | 50 | (12) | 41 | red | | dark | violet |

TABLE I-continued

| Example No. | Dye in reserve printing paste (application in places) amount parts | formula | content % | colour | | Dye in the printing paste for printing the base (application to whole surface) amount parts | formula | content % | colour | | Patterns obtained colour of the pattern | colour of the base |
|---|---|---|---|---|---|---|---|---|---|---|---|---|
| | | | | | G* | | | | | G* | | |
| | 50 | (4) | 48 | blue | | 50 | (14) | 44 | blue | | green | |
| 14 | 50 | (1) | 48 | yellow | G* | 80 | (14) | 44 | blue | | golden | blue |
| | 10 | (2) | 54 | red | | | | | | | yellow | |
| 15 | 90 | (2) | 54 | red | G* | 20 | (8) | 42 | yellow | G* | dark | dark |
| | 10 | (3) | 40 | blue | | 80 | (14) | 44 | blue | | red | blue |
| 16 | 50 | (1) | 48 | yellow | G* | 200 | (15) | 43 | blue | | light | light |
| | 10 | (4) | 48 | blue | | | | | | | green | blue |
| 17 | 50 | (1) | 48 | yellow | | 20 | (8) | 42 | yellow | G* | yellow | blue |
| | | | | | | 180 | (15) | 43 | blue | | | |
| 18 | 50 | (1) | 48 | Yellow | G* | 50 | (8) | 42 | yellow | G* | light | blue- |
| | 10 | (4) | 48 | blue | | 50 | (10) | 45 | blue | | green | green |
| 19 | 100 | (2) | 54 | red | | 40 | (8) | 42 | yellow | G* | red | dark |
| | | | | | | 160 | (15) | 43 | blue | | | green |
| 20 | 60 | (4) | 48 | blue | | 80 | (8) | 42 | yellow | G* | blue | light |
| | | | | | | 10 | (15) | 43 | blue | | | green |
| 21 | 90 | (2) | 54 | red | G* | 80 | (18) | 42 | yellow | G* | dark | olive |
| | 10 | (3) | 40 | blue | | 20 | (14) | 44 | blue | | red | green |
| 22 | 50 | (1) | 48 | yellow | G* | 60 | (9) | 43 | orange | G* | orange | light |
| | 10 | (2) | 54 | red | | 10 | (14) | 44 | blue | | | brown |
| 23 | 50 | (1) | 48 | yellow | G* | 60 | (9) | 43 | orange | G* | dark | maroon |
| | 50 | (4) | 48 | blue | | 80 | (15) | 43 | blue | | green | |
| 24 | 50 | (1) | 48 | yellow | G* | 20 | (8) | 42 | yellow | | light | dark |
| | 10 | (4) | 48 | blue | | 40 | (9) | 43 | orange | G* | green | brown |
| | | | | | | 40 | (14) | 44 | blue | | | |
| 25 | 50 | (1) | 48 | yellow | G* | 10 | (8) | 42 | yellow | G* | orange | dark |
| | 10 | (2) | 54 | red | | 40 | (9) | 43 | orange | | | brown |
| | | | | | | 40 | (14) | 44 | blue | | | |
| 26 | 100 | (2) | 54 | red | | 5 | (9) | 43 | orange | | red | violet |
| | | | | | | 5 | (10) | 45 | ruby | G* | | |
| | | | | | | 80 | (14) | 44 | blue | | | |
| 27 | 50 | (1) | 48 | yellow | | 10 | (9) | 43 | orange | G* | light green | navy blue |
| | | | | | | 80 | (14) | 44 | blue | | | |
| 28 | 50 | (1) | 48 | yellow | G* | 20 | (9) | 43 | orange | G* | dark | navy blue |
| | 10 | (4) | 48 | blue | | 80 | (14) | 44 | blue | | green | |
| 29 | 100 | (2) | 54 | red | | 80 | (8) | 42 | yellow | | red | black |
| | | | | | | 40 | (9) | 43 | orange | G* | | |
| | | | | | | 140 | (14) | 44 | blue | | | |
| 30 | 50 | (1) | 48 | yellow | | 80 | (8) | 42 | yellow | | light green | black |
| | | | | | | 40 | (9) | 43 | orange | G* | | |
| | | | | | | 140 | (14) | 44 | blue | | | |
| 31 | 60 | (4) | 48 | blue | | 80 | (8) | 42 | yellow | | blue | black |
| | | | | | | 40 | (9) | 43 | orange | G* | | |
| | | | | | | 140 | (14) | 44 | blue | | | |
| 32 | 50 | (1) | 48 | yellow | G* | 80 | (8) | 43 | yellow | G* | orange | black |
| | 10 | (2) | 54 | red | | 40 | (9) | 43 | orange | | | |
| | | | | | | 140 | (14) | 44 | blue | | | |
| 33 | 90 | (2) | 54 | red | G* | 80 | (8) | 42 | yellow | G* | claret | black |
| | 10 | (3) | 40 | blue | | 40 | (9) | 43 | orange | | | |
| | | | | | | 140 | (14) | 44 | blue | | | |

G* = mixture

EXAMPLES 34 TO 70

The procedure is carried out in the manner described in Example 1 but using in places a single reserve printing paste containing one of the thickeners given in the Examples 1 to 3, optionally together with 2-amino-2-methyl-1-propanol hydrochloride as catalyst, and in all cases hexamethylolmelamine-hexamethyl ether as reserving agent, but no dye; and then applying over the whole surface a printing paste for printing the base, the paste containing the thickener and binder given in Example 1 for the printing paste (E), and a dye or dye mixture according to the following Table II. There are obtained intermediate carriers which are storage-stable and fast to rubbing, as in Example 1; and on applying these carriers to polyester fabrics, there are obtained on the base light-coloured patterns having sharp contours and displaying the shades of colour given in the following Table II.

TABLE II

| Example No. | Dye amount parts | formula | content % | colour | | Resulting colour of base |
|---|---|---|---|---|---|---|
| 34 | 80 | (8) | 42 | yellow | | yellow |
| 35 | 60 | (9) | 43 | orange | | orange |
| 36 | 50 | (9) | 43 | orange | G* | light red |
| | 50 | (11) | 33 | pink | | |
| 37 | 40 | (9) | 43 | orange | G* | claret |
| | 40 | (12) | 41 | red | | |
| 38 | 40 | (9) | 43 | orange | G* | dark red |
| | 40 | (10) | 45 | ruby | | |
| 39 | 60 | (10) | 45 | ruby | | ruby |
| 40 | 80 | (11) | 43 | pink | | pink |
| 41 | 50 | (11) | 43 | pink | G* | light |
| | 50 | (12) | 41 | red | | claret |
| 42 | 80 | (12) | 41 | red | | dark claret |
| 43 | 60 | (13) | 42 | violet | | light violet |
| 44 | 50 | (12) | 41 | red | G* | dark |
| | 50 | (14) | 44 | blue | | violet |
| 45 | 80 | (14) | 44 | blue | | blue |
| 46 | 20 | (8) | 42 | yellow | G* | dark |
| | 80 | (14) | 44 | blue | | blue |
| 47 | 200 | (15) | 43 | blue | | sky-blue |
| 48 | 20 | (8) | 42 | yellow | G* | blue-green |
| | 180 | (15) | 43 | blue | | |
| 49 | 50 | (8) | 42 | yellow | G* | dark green |
| | 50 | (14) | 44 | blue | | |
| 50 | 40 | (8) | 42 | yellow | G* | green |
| | 160 | (15) | 43 | blue | | |
| 51 | 80 | (8) | 42 | yellow | G* | light green |
| | 20 | (15) | 43 | blue | | |
| 52 | 80 | (8) | 42 | yellow | G* | olive |
| | 20 | (14) | 44 | blue | | green |
| 53 | 60 | (9) | 33 | orange | G* | maroon |
| | 10 | (14) | 44 | blue | | |
| 54 | 60 | (9) | 33 | orange | G* | light |
| | 80 | (15) | 43 | blue | | brown |
| 55 | 20 | (8) | 42 | yellow | G* | brown |
| | 40 | (9) | 33 | orange | | |
| | 40 | (14) | 44 | blue | | |
| 56 | 10 | (8) | 42 | yellow | G* | dark brown |
| | 40 | (9) | 43 | orange | | |
| | 50 | (14) | 44 | blue | | |
| 57 | 5 | (9) | 43 | orange | G* | violet-blue |
| | 5 | (10) | 45 | ruby | | |
| | 80 | (14) | 44 | blue | | |
| 58 | 10 | (9) | 43 | orange | G* | navy blue |
| | 80 | (14) | 44 | blue | | |
| 59 | 20 | (9) | 43 | orange | G* | dark navy blue |
| | 80 | (14) | 44 | blue | | |
| 60 | 80 | (8) | 42 | yellow | G* | black |
| | 40 | (9) | 43 | orange | | |
| | 140 | (14) | 44 | blue | | |
| 61 | 50 | (16) | 43 | yellow | | yellow |

TABLE II-continued

| Example No. | Dye amount parts | formula | content % | colour | Resulting colour of base |
|---|---|---|---|---|---|
| 62 | 50 | (17) | 41 | yellow | yellow |
| 63 | 50 | (18) | 39 | yellow | yellow |
| 64 | 50 | (19) | 45 | yellow | yellow |
| 65 | 50 | (20) | 42 | yellow | yellow |
| 66 | 50 | (21) | 36 | yellow | yellow |
| 67 | 50 | (22) | 46 | yellow | yellow |
| 68 | 50 | (23) | 42 | scarlet | scarlet |
| 69 | 50 | (24) | 43 | violet | violet |
| 70 | 50 | (25) | 44 | yellow | yellow |

G* = mixture

EXAMPLES 71 TO 386

Intermediate paper carriers are printed, in the gravure-printing process, firstly in places with the following reserve printing paste (A), and subsequently, without intermediate drying, over the whole surface with the following printing paste (B) for printing the base, the applied amount for each of the two printing pastes (A) and (B) being 10 to 12 g of paste per square meter of paper. After being printed with the two pastes (A) and (B), the intermediate carriers are dried at 100° C. for 10 seconds. The carriers obtained are storage-stable and fast to rubbing.

Reserve printing paste A 200 parts of hexamethylolmelaminehexamethyl ether (commercial product consisting of hexamethylolmelamine which is etherified to the extent of 90 to 98% with methanol) as reserving agent (a), 35 parts of an ammonium polyacrylate (15%) as synthetic thickener ($b_1$), and optionally at least one dye according to the following Tables III to VII, as non-reservable dye (c).

Paste A is made up with water to 1000 parts.

Printing paste B for printing the base (background)

either 35 parts of an ammonium polyacrylate (15%) as synthetic thickener ($b_1$) or 450 parts of sodium alginate (10%) as natural thickener ($b_2$), and at least one dye according to the following Tables III to VII, as reservable dye (g).

Fabrics made from the fibres listed in the following are printed with the intermediate carriers in the transfer printing process, the individual fabrics being pressed together with the respective intermediate carriers for 30 seconds in an ironing press under an excess pressure of 0.04 to 0.06 bar. There are obtained on the respective fabrics the patterns given in the following Tables III to VII, the patterns having sharp contours, that is to say, without aureoles.

Fibre materials polyester fabric, weight per unit area 50–200 g/m$^2$ (Table III), fabric made from modified polyamide, weight 50–200 g/m$^2$ (Table IV), fabric made from cellulose triacetate, weight 50–200 g/m$^2$ (Table V), polyamide fabric, weight 50–200 g/m$^2$ (Table VI), and polyacrylonitrile fabric, weight 50–200 g/m$^2$ (Table VII).

TABLE III (polyester)

| Example No. | Dye in reserve printing paste (application in places) amount parts | formula | content % | colour | Printing paste for printing the base (application to whole surface) dye amount parts | formula | content % | colour | | thickener | Patterns obtained colour of the pattern | colour of the base |
|---|---|---|---|---|---|---|---|---|---|---|---|---|
| 71 | 0 | — | — | — | 20 | (9) | 43 | orange | G* | $b_1$ | silver | navy blue |
| | | | | | 80 | (14) | 44 | blue | | | | |
| 72 | 0 | — | — | — | 40 | (21) | 36 | yellow | G* | | light yellow | black |
| | | | | | 40 | (9) | 43 | orange | | | | |
| | | | | | 120 | (14) | 44 | blue | | | | |
| 73 | 50 | (1) | 48 | yellow | 60 | (9) | 43 | orange | | $b_1$ | yellow | orange |
| 74 | 50 | (1) | 48 | yellow | 40 | (10) | 45 | ruby | | $b_1$ | yellow | ruby |
| 75 | 50 | (1) | 48 | yellow | 80 | (11) | 33 | brilliant pink | | $b_2$ | yellow | pink |
| 76 | 50 | (1) | 48 | yellow | 60 | (13) | 42 | violet | | $b_2$ | yellow | violet |
| 77 | 50 | (1) | 48 | yellow | 80 | (14) | 44 | blue | | $b_1$ | olive-green | blue |
| 78 | 50 | (1) | 48 | yellow | 120 | (15) | 43 | brilliant blue | | $b_2$ | light green | light blue |
| 79 | 50 | (1) | 48 | yellow | 40 | (21) | 36 | yellow | G* | $b_2$ | light green | black |
| | | | | | 40 | (9) | 43 | orange | | | | |
| | | | | | 120 | (14) | 44 | blue | | | | |
| 80 | 100 | (2) | 54 | red | 80 | (8) | 42 | yellow | | $b_2$ | red | golden yellow |
| 81 | 100 | (2) | 54 | red | 40 | (21) | 36 | yellow | | $b_2$ | red | yellow |
| 82 | 100 | (2) | 54 | red | 40 | (10) | 45 | ruby | | $b_1$ | light red | ruby |
| 83 | 100 | (2) | 54 | red | 80 | (12) | 41 | red | | $b_1$ | light red | claret |
| 84 | 100 | (2) | 54 | red | 80 | (14) | 44 | blue | | $b_1$ | red | blue |
| 85 | 100 | (2) | 54 | red | 120 | (15) | 43 | brilliant blue | | $b_2$ | red | light blue |
| 86 | 100 | (2) | 54 | red | 20 | (9) | 43 | orange | G* | $b_1$ | red | navy blue |
| | | | | | 80 | (14) | 44 | blue | | | | |
| 87 | 100 | (2) | 54 | red | 40 | (21) | 36 | yellow | G* | $b_2$ | red | black |
| | | | | | 40 | (9) | 43 | orange | | | | |
| | | | | | 120 | (14) | 44 | blue | | | | |
| 88 | 100 | (3) | 40 | blue | 80 | (8) | 42 | yellow | | $b_2$ | dark blue | golden yellow |
| 89 | 100 | (3) | 40 | blue | 40 | (21) | 36 | yellow | | $b_2$ | dark blue | yellow |
| 90 | 100 | (3) | 40 | blue | 60 | (9) | 43 | orange | | $b_1$ | dark blue | orange |
| 91 | 100 | (3) | 40 | blue | 80 | (11) | 33 | brilliant pink | | $b_2$ | blue | pink |
| 92 | 100 | (3) | 40 | blue | 80 | (12) | 41 | red | | $b_1$ | blue | claret |
| 93 | 100 | (3) | 40 | blue | 120 | (15) | 43 | brilliant blue | | $b_2$ | dark blue | light blue |
| 94 | 100 | (3) | 40 | blue | 20 | (9) | 43 | orange | G* | $b_1$ | dark blue | navy blue |
| | | | | | 80 | (14) | 44 | blue | | | | |
| 95 | 100 | (3) | 40 | blue | 80 | (8) | 42 | yellow | G* | $b_2$ | dark blue | black |
| | | | | | 45 | (9) | 43 | orange | | | | |
| | | | | | 135 | (14) | 44 | blue | | | | |
| 96 | 100 | (3) | 40 | blue | 40 | (21) | 36 | yellow | G* | $b_2$ | dark blue | black |
| | | | | | 40 | (9) | 43 | orange | | | | |
| | | | | | 120 | (14) | 44 | blue | | | | |
| 97 | 60 | (4) | 48 | blue | 80 | (8) | 42 | yellow | | $b_2$ | blue | golden yellow |
| 98 | 60 | (4) | 48 | blue | 40 | (21) | 36 | yellow | | $b_2$ | blue | yellow |
| 99 | 60 | (4) | 48 | blue | 60 | (9) | 43 | orange | | $b_1$ | blue | orange |
| 100 | 60 | (4) | 48 | blue | 40 | (10) | 45 | rubin | | $b_1$ | blue | ruby |
| 101 | 60 | (4) | 48 | blue | 80 | (11) | 33 | brilliant pink | | $b_2$ | blue | pink |
| 102 | 60 | (4) | 48 | blue | 80 | (12) | 41 | red | | $b_1$ | blue | claret |
| 103 | 60 | (4) | 48 | blue | 60 | (13) | 42 | violet | | $b_2$ | blue | violet |
| 104 | 60 | (4) | 48 | blue | 80 | (14) | 44 | blue | | $b_1$ | light blue | dark blue |
| 105 | 60 | (4) | 48 | blue | 120 | (15) | 43 | brilliant blue | | $b_2$ | dark blue | light blue |
| 106 | 60 | (4) | 48 | blue | 20 | (9) | 43 | orange | G* | $b_1$ | blue | navy blue |
| | | | | | 80 | (14) | 44 | blue | | | | |
| 107 | 60 | (4) | 48 | blue | 40 | (21) | 36 | yellow | G* | $b_2$ | blue | black |
| | | | | | 40 | (9) | 43 | orange | | | | |
| | | | | | 120 | (14) | 44 | blue | | | | |
| 108 | 100 | (5) | 32 | turquoise | 80 | (8) | 42 | yellow | | $b_2$ | light blue | golden yellow |
| 109 | 100 | (5) | 32 | turquoise | 40 | (21) | 36 | yellow | | $b_2$ | light blue | yellow |
| 110 | 100 | (5) | 32 | turquoise | 60 | (9) | 43 | orange | | $b_1$ | blue-green | orange |
| 111 | 100 | (5) | 32 | turquoise | 40 | (10) | 45 | ruby | | $b_1$ | blue | ruby |
| 112 | 100 | (5) | 32 | turquoise | 80 | (11) | 33 | brilliant pink | | $b_2$ | blue | pink |
| 113 | 100 | (5) | 32 | turquoise | 80 | (12) | 41 | red | | $b_1$ | blue | claret |
| 114 | 100 | (5) | 32 | turquoise | 60 | (13) | 42 | violet | | $b_2$ | blue-green | violet |
| 115 | 100 | (5) | 32 | turquoise | 80 | (14) | 44 | blue | | $b_1$ | light-blue | dark blue |

TABLE III-continued

| Example No. | Dye in reserve printing paste (application in places) amount parts | formula | content % | colour | Printing paste for printing the base (application to whole surface) (polyester) dye amount parts | formula | content % | colour | thickener | Patterns obtained colour of the pattern | colour of the base |
|---|---|---|---|---|---|---|---|---|---|---|---|
| 116 | 100 | (5) | 32 | turquoise | 120 | (15) | 43 | brilliant blue | $b_2$ | blue-green | light blue |
| 117 | 100 | (5) | 32 | turquoise | 20 | (9) | 43 | orange } G* | $b_1$ | light blue | navy blue |
| | | | | | 80 | (14) | 44 | blue | | | |
| 118 | 100 | (5) | 32 | turquoise | 80 | (8) | 42 | yellow } G* | $b_2$ | blue-green | black |
| | | | | | 45 | (9) | 43 | orange | | | |
| | | | | | 135 | (14) | 44 | blue | | | |
| 119 | 100 | (5) | 32 | turquoise | 40 | (21) | 36 | yellow } G* | $b_2$ | blue-green | black |
| | | | | | 40 | (9) | 43 | orange | | | |
| | | | | | 120 | (14) | 44 | blue | | | |
| | 50 | (1) | 48 | | | | | | | | |
| 120 | 10 | (4) | 48 | yellow G* blue | 80 | (8) | 42 | yellow | $b_2$ | green | golden yellow |
| 121 | 50 | (1) | 48 | yellow } G* | 40 | (21) | 36 | yellow | $b_2$ | green | yellow |
| | 10 | (4) | 48 | blue | | | | | | | |
| 122 | 50 | (1) | 48 | yellow } G* | 60 | (9) | 43 | orange | $b_1$ | green | orange |
| | 10 | (4) | 48 | blue | | | | | | | |
| 123 | 50 | (1) | 48 | yellow } G* | 40 | (10) | 45 | ruby | $b_1$ | green | ruby |
| | 10 | (4) | 48 | blue | | | | | | | |
| 124 | 50 | (1) | 48 | yellow } G* | 80 | (12) | 41 | red | $b_1$ | green | claret |
| | 10 | (4) | 48 | blue | | | | | | | |
| 125 | 50 | (1) | 48 | yellow } G* | 60 | (13) | 42 | violet | $b_2$ | green | violet |
| | 10 | (4) | 48 | blue | | | | | | | |
| 126 | 50 | (1) | 48 | yellow } G* | 80 | (14) | 44 | blue | $b_1$ | green | dark blue |
| | 10 | (4) | 48 | blue | | | | | | | |
| 127 | 50 | (1) | 48 | yellow } G* | 80 | (8) | 42 | yellow } G* | $b_2$ | green | black |
| | | | | | 45 | (9) | 43 | orange | | | |
| | 10 | (4) | 48 | blue | 135 | (14) | 43 | blue | | | |
| 128 | 50 | (1) | 48 | yellow } G* | 40 | (21) | 36 | yellow } G* | $b_2$ | green | black |
| | | | | | 40 | (9) | 43 | orange | | | |
| | 10 | (4) | 48 | blue | 120 | (14) | 44 | blue | | | |

G* = mixture

TABLE IV

| Example No. | Dye in reserve printing paste (application in places) amount parts | formula | content % | colour | Printing paste for printing the base (application to whole surface) (modified polyamide) Dye amount parts | formula | content % | colour | thickener | Patterns obtained colour of the pattern | colour of the base |
|---|---|---|---|---|---|---|---|---|---|---|---|
| 129 | 0 | — | — | — | 100 | (8) | 42 | yellow | $b_2$ | white | yellow |
| 130 | 0 | — | — | — | 50 | (21) | 36 | yellow | $b_2$ | white | golden yellow |
| 131 | 0 | — | — | — | 50 | (9) | 43 | orange | $b_1$ | light yellow | orange |
| 132 | 0 | — | — | — | 40 | (10) | 45 | ruby | $b_1$ | light red | ruby |
| 133 | 0 | — | — | — | 100 | (11) | 33 | brilliant pink | $b_2$ | white | pink |
| 134 | 0 | — | — | — | 80 | (12) | 41 | red | $b_1$ | light red | claret |
| 135 | 0 | — | — | — | 60 | (13) | 42 | violet | $b_2$ | white | violet |
| 136 | 0 | — | — | — | 80 | (14) | 44 | blue | $b_1$ | light blue | dark blue |
| 137 | 0 | — | — | — | 120 | (15) | 43 | brilliant blue | $b_2$ | light olive | light blue |
| 138 | 0 | — | — | — | 15 | (9) | 43 | orange } G* | $b_1$ | silver | navy blue |
| | | | | | 85 | (14) | 44 | blue | | | |
| 139 | 0 | — | — | — | 100 | (8) | 42 | yellow } G* | $b_2$ | olive | black |
| | | | | | 30 | (9) | 43 | orange | | | |
| | | | | | 140 | (14) | 44 | blue | | | |
| 140 | 0 | — | — | — | 50 | (21) | 36 | yellow } G* | $b_2$ | light grey | black |
| | | | | | 30 | (9) | 43 | orange | | | |
| | | | | | 140 | (14) | 44 | blue | | | |
| 141 | 50 | (1) | 48 | yellow | 50 | (9) | 43 | orange | $b_1$ | yellow | orange |
| 142 | 50 | (1) | 48 | yellow | 40 | (10) | 45 | ruby | $b_1$ | yellow | ruby |
| 143 | 50 | (1) | 48 | yellow | 100 | (11) | 33 | brilliant pink | $b_2$ | yellow | pink |

TABLE IV-continued

| Example No. | Dye in reserve printing paste (application in places) amount parts | formula | content % | colour | Printing paste for printing the base (application to whole surface) (modified polyamide) Dye amount parts | formula | content % | colour | thickener | Patterns obtained colour of the pattern | colour of the base |
|---|---|---|---|---|---|---|---|---|---|---|---|
| 144 | 50 | (1) | 48 | yellow 80 | (12) | 41 | red | $b_1$ | yellow | claret | |
| 145 | 50 | (1) | 48 | yellow | 60 | (13) | 42 | violet | $b_2$ | yellow | violet |
| 146 | 50 | (1) | 48 | yellow | 80 | (14) | 44 | blue | $b_1$ | light green | dark blue |
| 147 | 50 | (1) | 48 | yellow | 120 | (15) | 43 | brilliant blue | $b_2$ | light green | light blue |
| 148 | 50 | (1) | 48 | yellow | 15 | (9) | 43 | orange } G* | $b_1$ | light green | navy blue |
| | | | | | 85 | (14) | 44 | blue | | | |
| 149 | 50 | (1) | 48 | yellow | 100 | (8) | 42 | yellow } G* | $b_2$ | light green | black |
| | | | | | 30 | (9) | 43 | orange | | | |
| | | | | | 40 | (14) | 44 | blue | | | |
| 150 | 50 | (1) | 48 | yellow | 50 | (21) | 36 | yellow } G* | $b_2$ | light green | black |
| | | | | | 30 | (9) | 43 | orange | | | |
| | | | | | 140 | (14) | 44 | blue | | | |
| 151 | 100 | (2) | 54 | red | 100 | (8) | 42 | yellow | $b_2$ | red | yellow |
| 152 | 100 | (2) | 54 | red | 50 | (21) | 36 | yellow | $b_2$ | red | yellow |
| 153 to 160 | 100 | (2) | 54 | red | as Examples 142 and 144 to 150 | | | | | as Examples 82, 83, 12 and 84 to 87 | |
| 161 to 170 | 100 | (3) | 40 | blue | as Examples 150, 152, 141 to 144 and 147 to 150 | | | | | as Examples 88, 89, 90, 8 and 91 to 96. | |
| 171 to 182 | 60 | (4) | 48 | blue | as Examples 151, 152 and 141 to 150 | | | | | as Examples 97 to 106, 31 and 107 | |
| 183 to 193 | 100 | (5) | 32 | turquoise 148 to 150 | as Examples 151, 152, 141 to 146 and and 117 to 119 | | | | | as Examples 108 to 115 | |
| 194 to 205 | 50 | (1) | 48 | yellow } G* | as Examples 151, 152 and 141 to 150 | | | | | as Examples 120 to 123, 9. 124 to 126, 16, 28, 127 and 128 | |
| | 10 | (4) | 48 | blue | | | | | | | |

G = mixture

TABLE V

| Example No. | Dye in reserve printing paste (application in places) amount parts | formula | content % | colour | Printing paste for printing the base (application to whole surface) (Cellulose triacetate) dye amount parts | formula | content % | colour | thickener | Patterns obtained colour of the pattern | colour of the base |
|---|---|---|---|---|---|---|---|---|---|---|---|
| 206 to 217 | 0 | — | — | — | as Examples 129 to 140 | | | | | as Examples 129 to 140 | |
| 218 to 217 | 50 | (1) | 48 | yellow | as Examples 141 to 150 | | | | | as Examples 141 to 150 | |
| 228 to 238 | 100 | (2) | 54 | red | as Examples 151, 152, 142 and 144 to 150 | | | | | as Examples 151, 152, 82, 83, 12 and 84 to 87 | |
| 239 to 245 | 100 | (3) | 40 | blue | as Examples 151, 152, 141 to 144 and 147 | | | | | as Examples 86, 89, 90, 8, 91, 92 and 93 | |
| 246 to 257 | 60 | (4) | 48 | blue | as Examples 151, 152 and 141 to 150 | | | | | as Examples 97 to 106, 31 and 107 | |
| 258 to 269 | 100 | (5) | 32 | turquoise | as Examples 151, 152 and 141 to 150 | | | | | as Examples 108 to 119 | |
| 270 to 281 | 50 | (1) | 48 | yellow } G* | as Examples 151, 152 and 141 to 150 | | | | | as Examples 120 to 123, 9, 124 to 126, 16, 28, 127 and 128 | |
| | 10 | (4) | 48 | blue | | | | | | | |

G* = mixture

TABLE VI (polyamide)

| Ex. No. | Dye in reserve printing paste (application in places) amount parts | formula | content % | colour | Printing paste for printing the base (application to whole surface) Dye amount parts | formula | content % | colour | thickener | Patterns obtained colour of the pattern | colour of the base |
|---|---|---|---|---|---|---|---|---|---|---|---|
| 282 | 0 | — | — | — | 40 | (21) | 36 | yellow | $b_2$ | white | yellow |
| 283 | 0 | — | — | — | 80 | (25) | 44 | golden yellow | $b_2$ | light yellow | golden yellow |
| 284 | 0 | — | — | — | 150 | (11) | 33 | brilliant pink | $b_2$ | pink | red |
| 285 | 0 | — | — | — | 100 | (14) | 44 | blue | $b_1$ | light blue | dark blue |
| 286 | 0 | — | — | — | 120 | (15) | 43 | brilliant blue | $b_2$ | white | light blue |
| 287 | 0 | — | — | — | 20 | (21) | 36 | yellow | $b_2$ | light grey | navy blue |
| | | | | | 30 | (11) | 33 | brilliant | G* | | |
| | | | | | 90 | (14) | 44 | pink blue | $b_2$ | | |
| 288 | 0 | — | — | — | 40 | (21) | 36 | yellow | $b_2$ | olive-yellow | black |
| | | | | | 20 | (25) | 44 | golden | | | |
| | | | | | 50 | (11) | 33 | yellow | G* | | |
| | | | | | 130 | (14) | 44 | brilliant pink blue | | | |
| 289 to 294 | 80 | (1) | 48 | yellow | as Examples 283 to 288 | | | | | yellow to green | as Examples 283 to 288 |
| 295 to 300 | 100 | (6) | 49 | yellow | as Examples 283 to 288 | | | | | yellow to green | as Examples 283 to 288 |
| 301 to 306 | 100 | (2) | 54 | red | as Examples 282, 283 and 285 to 288 | | | | | red | as Examples 282, 283 and 285 to 288 |
| 307 to 311 | 200 | (7) | 31 | red | as Examples 284 to 288 | | | | | light red | as Examples 284 to 288 |
| 312 to 315 | 100 | (3) | 40 | blue | as Examples 282 to 285 | | | | | blue | as Examples 282 to 285 |
| 316 to 319 | 80 | (4) | 48 | blue | as Examples 284, 285, 287 and 288 | | | | | blue | as Examples 284, 285, 287 and 288 |
| 320 to 325 | 120 | (5) | 32 | turquoise | as Examples 282 to 285, 287 and 288 | | | | | blue-green | as Examples 282 to 285, 287 and 288 |
| 326 to 322 | 50 | (1) | 48 | yellow | as Examples 282 to 288 | | | | | green | as Examples 282 to 288 |
| | 10 | (4) | 48 | blue | G* | | | | | | |

G* = mixture

TABLE VII (polyacrylonitrile)

| Example No. | Dye in reserve printing paste (application in places) amount parts | formula | content % | colour | Printing paste for printing the base (application to whole surface) Dye amount parts | formula | content % | colour | thickener | Patterns obtained colour of the pattern | colour of the base |
|---|---|---|---|---|---|---|---|---|---|---|---|
| 333 | 0 | — | — | — | 80 | (9) | 43 | orange | $b_1$ | light brown | orange-brown |
| 334 | 0 | — | — | — | 100 | (11) | 33 | brilliant pink | $b_2$ | light grey | light red |
| 335 | 0 | — | — | — | 50 | (12) | 41 | red | $b_1$ | light grey | light violet |
| 336 | 0 | — | — | — | 70 | (13) | 42 | violet | $b_2$ | light grey | dark violet |
| 337 | 0 | — | — | — | 100 | (14) | 44 | blue | $b_1$ | light yellow | blue |
| 338 | 0 | — | — | — | 120 | (15) | 43 | brilliant blue | $b_2$ | light yellow | light blue |
| 339 | 0 | — | — | — | 40 | (9) | 43 | orange | $b_1$ | grey | navy blue |
| | | | | | 120 | (14) | 44 | blue | G* | | |
| 340 | 0 | — | — | — | 110 | (8) | 42 | yellow | $b_2$ | light yellow | black |
| | | | | | 35 | (9) | 43 | orange | | | |
| | | | | | 20 | (13) | 42 | violet | G* | | |
| | | | | | 135 | (14) | 44 | blue | | | |
| 341 | 0 | — | — | — | 35 | (21) | 36 | yellow | | light yellow | black |
| | | | | | 30 | (9) | 43 | orange | | | |
| | | | | | 15 | (13) | 42 | violet | G* | | |
| | | | | | 150 | (14) | 44 | blue | | | |
| 342 to 350 | 80 | (1) | 48 | yellow | as Examples 333 to 341 | | | | | yellow to green | as Examples 333 to 341 |

TABLE VII-continued

| Example No. | Dye in reserve printing paste (application in places) amount parts | formula | content % | colour | Printing paste for printing the base (application to whole surface) Dye amount parts | formula | content % | colour | thickener | Patterns obtained colour of the pattern | colour of the base |
|---|---|---|---|---|---|---|---|---|---|---|---|
| | | | | | (polyacrylonitrile) | | | | | | |
| 351 to 359 | 100 | (6) | 49 | yellow | as Examples 333 to 341 | | | | | yellow to green | as Examples 333 to 341 |
| 360 | 250 | (7) | 31 | red | 100 | (8) | 42 | yellow | $b_2$ | red | yellow |
| 361 | 250 | (7) | 31 | red | 50 | (21) | 36 | yellow | $b_2$ | red | yellow |
| 362 to 368 | 250 | (7) | 31 | red | as Examples 335 to 341 | | | | | red | as Examples 335 to 341 |
| 369 to 377 | 80 | (4) | 48 | blue | as Examples 360, 361, 333 to 336 and 339 to 341 | | | | | blue | as Examples 360, 361, 333 to 336 and 339 to 341 |
| 378 to 386 | 85 | (6) | 49 | yellow | as Examples 333 to 341 | | | | | green | as Examples 333 to 341 |
| | 15 | (4) | 48 | blue | | | | | | | |

G* = mixture

EXAMPLES 387 TO 402

Intermediate carriers made of paper are printed, in the gravure printing process, firstly in places with one of the following reserve printing inks (A) to (D), and subsequently, without intermediate drying, over the whole surface with one of the following inks (E) to (H) for printing the base, the deposited amount for each of the employed inks being 8 to 10 g of ink per square meter of paper. The intermediate carriers are thereupon dried at 100° C. for 10 seconds. They are storage-stable and fast to rubbing.

Reserve printing ink A 200 parts of hexamethylolmelaminehexamethyl ether (commercial product),
78 parts of cellulose acetopropionate,
20 parts of 2-amino-2-methyl-propanol hydrochloride,
312 parts of isopropanol,
312 parts of n-propanol, and
78 parts of water.

Reserve printing ink B 150 parts of hexamethylolmelaminehexamethyl ether (commercial product),
78 parts of cellulose acetopropionate,
50 parts of the non-reservable yellow dye of the formula (I) (48%),
15 parts of 2-amino-2-methyl-propanol hydrochloride,
315 parts of isopropanol,
315 parts of n-propanol, and
78 parts of water.

Reserve printing ink C 150 parts of hexamethylolmelaminehexamethyl ether (commercial product),
74 parts of cellulose acetopropionate,
100 parts of the non-reservable red dye of the formula (2) (54%),
15 parts of 2-amino-2-methyl-propanol hydrochloride,
294 parts of isopropanol,
294 parts of n-propanol, and
74 parts of water.

Reserve printing ink D 150 parts of hexamethylolmelaminehexamethyl ether (commercial product),
77 parts of cellulose acetopropionate,
60 parts of the non-reservable blue dye of the formula (4) (48%),
15 parts of 2-amino-2-methyl-propanol hydrochloride,
310 parts of isopropanol,
310 parts of n-propanol, and
77 parts of water.

Ink E for printing the base 91 parts of cellulose acetopropionate,
90 parts of the reservable, orange-coloured dye of the formula (9) (43%),
364 parts of isopropanol,
364 parts of n-propanol, and
91 parts of water.

Ink F for printing the base 88 parts of cellulose acetopropionate,
120 parts of the reservable red dye of the formula (12) (41%),
352 parts of isopropanol,
352 parts of n-propanol, and
88 parts of water.

Ink G for printing the base

As ink F, but with replacement of 120 parts of the dye of the formula (12) by 120 parts of the reservable blue dye the formula (14) (44%).

Ink H for printing the base 62 parts of cellulose acetopropionate,
120 parts of the reservable yellow dye of the formula (8) (42%),
65 parts of the reservable orange-coloured dye of the formula (9) (43%),
200 parts of the reservable blue dye of the formula (14) (44%),
246 parts of isopropanol,
246 parts of n-propanol, and
62 parts of water.

Fabrics made from polyester (weight 100 g/m$^2$) are printed with the intermediate carriers by the transfer printing process, the individual fabrics being pressed together with the respective intermediate carriers for 30 seconds in an ironing press with an excess pressure of 0.04 to 0.06 bar. There are obtained on the respective fabrics the patterns given in the following Table VIII, the patterns having sharp contours, that is to say, being without aureoles.

TABLE VIII

| Example No. | Reserve printing ink (application in places) designation | Printing ink for dyeing the base (application to whole surface) designation | Patterns obtained: Colour of the pattern | Patterns obtained: Colour of the base |
|---|---|---|---|---|
| 387 | A | E | light yellow | orange |
| 388 | A | F | pink | violet |
| 389 | A | G | light blue | dark blue |
| 390 | A | H | silver-grey | black |
| 391 | B | E | yellow | orange |
| 392 | B | F | yellow | violet |
| 393 | B | G | green | dark blue |
| 394 | B | H | green-yellow | black |
| 395 | C | E | red | orange |
| 396 | C | F | red | violet |
| 397 | C | G | red | dark blue |
| 398 | C | H | red | black |
| 399 | D | E | green | orange |
| 400 | D | F | dark blue | violet |
| 401 | D | G | light blue | dark blue |
| 402 | D | H | blue-green | black |

EXAMPLES 403 TO 418

The procedure is carried out as described in Examples 387 to 402, the intermediate carriers being printed however with the following inks.

Ink A 200 parts of hexamethylolmelamine-hexamethyl ether,
62 parts of carboxymethyl cellulose,
20 parts of 2-amino-2-methyl-propanol hydrochloride,
562 parts of ethanol,
140 parts of ethyl acetate, and
16 parts of ethylene glycol.

Ink B 150 parts of hexamethylolmelaminehexamethyl ether,
63 parts of carboxymethyl cellulose,
50 parts of the dye of the formula (1) (48%),
15 parts of 2-amino-2-methyl-propanol hydrochloride,
566 parts of ethanol,
141 parts of ethyl acetate, and
15 parts of ethylene glycol.

Ink C 150 parts of hexamethylolmelaminehexamethyl ether,
58 parts of carboxymethyl cellulose,
100 parts of the dye of the formula (2) (54%),
15 parts of 2-amino-2-methyl-propanol hydrochloride,
530 parts of ethanol,
132 parts of ethyl acetate, and
15 parts of ethylene glycol.

Ink D 150 parts of hexamethylolmelaminehexamethyl ether,
62 parts of carboxymethyl cellulose,
60 parts of the dye of the formula (4) (48%),
15 parts of 2-amino-2-methyl-propanol hydrochloride,
558 parts of ethanol,
140 parts of ethyl acetate, and
15 parts of ethylene glycol.

Ink E 73 parts of carboxymethyl cellulose,
90 parts of the dye of the formula (9) (43%),
656 parts of ethanol,
163 parts of ethyl acetate, and
18 parts of ethylene glycol.

Ink F 70 parts of carboxymethyl cellulose,
120 parts of the dye of the formula (12) (41%),
634 parts of ethanol,
158 parts of ethyl acetate, and
18 parts of ethylene glycol.

Ink G

As in the case of ink F, but with replacement of 120 parts of the dye of the formula (12) by 120 parts of the dye of the formula (14) (44%).

Ink H 49 parts of carboxymethyl cellulose,
120 parts of the dye of the formula (8) (42%),
65 parts of the dye of the formula (9) (43%),
200 parts of the dye of the formula (14) (44%),
443 parts of ethanol,
111 parts of ethyl acetate, and
12 parts of ethylene glycol.

The intermediate carriers obtained are storage-stable and fast to rubbing.

Polyester fabrics are printed, in the manner given in Examples 387 to 402, with the combinations of inks A to H according to the following Table IX.

TABLE IX

| Example No. | Reserve printing ink designation | Ink for printing the base designation |
|---|---|---|
| 403 | A | E |
| 404 | A | F |
| 405 | A | G |
| 406 | A | H |
| 407 | B | E |
| 408 | B | F |
| 409 | B | G |
| 410 | B | H |
| 411 | C | E |
| 412 | C | F |
| 413 | C | G |
| 414 | C | H |
| 415 | D | E |
| 416 | D | F |
| 417 | D | G |
| 418 | D | H |

There are obtained in these tests patterns having sharp contours, that is to say, without aureoles, the colours of the patterns corresponding to the colours given in Table VIII.

EXAMPLES 419 TO 434

The procedure is carried out in the manner described in Examples 387 to 402, the intermediate carriers being printed however with the following inks:

Ink A 200 parts of hexamethylolmelaminehexamethyl ether,
23 parts of hydroxypropyl cellulose,
20 parts of 2-amino-2-methyl-propanol hydrochloride,
507 parts of ethanol, and
250 parts of water.

Ink B 150 parts of hexamethylolmelaminehexamethyl ether,
24 parts of hydroxypropyl cellulose,
50 parts of the dye of the formula (1) (48%),
15 parts of 2-amino-2-methyl-propanol hydrochloride,
510 parts of ethanol, and
251 parts of water.

Ink C 150 parts of hexamethylolmelaminehexamethyl ether,
22 parts of hydroxypropyl cellulose,
100 parts of the dye of the formula (2) (54%),
15 parts of 2-amino-2-methyl-propanol hydrochloride,
478 parts of ethanol, and
235 parts of water.

Ink D 150 parts of hexamethylolmelaminehexamethyl ether,
23 parts of hydroxypropyl cellulose,
60 parts of the dye of the formula (4) (48%),
15 parts of 2-amino-2-methyl-propanol hydrochloride,
504 parts of ethanol, and
248 parts of water.

Ink E 27 parts of hydroxypropyl cellulose,
90 parts of the dye of the formula (9) (43%),
592 parts of ethanol, and
291 parts of water.

Ink F 26 parts of hydroxypropyl cellulose,
120 parts of the dye of the formula (12) (41%),
572 parts of ethanol, and
282 parts of water.

Ink G

As ink F, but with the replacement of 120 parts of the dye of the formula (12) by 120 parts of the dye of the formula (14) (44%).

Ink H 18 parts of hydroxypropyl cellulose,
120 parts of the dye of the formula (8) (42%),
65 parts of the dye of the formula (9) (43%),
200 parts of the dye of the formula (14) (44%),
400 parts of ethanol, and
197 parts of water.

The intermediate carriers obtained are storage-stable and fast to rubbing.

Polyester fabrics are printed as given in Examples 387 to 402 with the combinations of the inks A to H according to the following Table X:

TABLE X

| Example No. | Reserve printing ink designation | Ink for printing the base designation |
|---|---|---|
| 419 | A | E |
| 420 | A | F |
| 421 | A | G |
| 422 | A | H |
| 423 | B | E |
| 424 | B | F |
| 425 | B | G |
| 426 | B | H |
| 427 | C | E |
| 428 | C | F |
| 429 | C | G |
| 430 | C | H |
| 431 | D | E |
| 432 | D | F |
| 433 | D | G |
| 434 | D | H |

There are obtained in these tests patterns having sharp contours, that is to say, without aureoles, the colours of the patterns corresponding to the colours given in Table VIII.

What is claimed is:

1. A thermal dry transfer printing process for printing synthetic fibre materials with multi-colour effects, in which process an intermediate carrier is printed, in any chosen sequence, (1) in places with a reserve printing paste or reserve printing ink, and (2) with a printing paste or printing ink for printing the ground, the reserve printing paste or ink (1) containing (a) 10 to 25 percent by weight of a reserving agent which is pentamethylolmelaminetetramethyl ether or hexamethylolmelaminehexamethyl ether, (b) 0.2 to 15 percent by weight of a thickener, (c) 0 to 10 percent by weight of a non-reservable, sublimable disperse dye, which is a nitro-dye of the aniline series; an azo dye of the benzene series; or an anthraquinone, quinoline, pyrazolone, triazole, pyridone or styryl dye, each being convertable to the vapour state at 160° to 220° C., (d) 0 to 2.5 percent by weight of a curing catalyst and (e) 50 to 90 percent by weight of water or an organic solvent and the printing paste or ink (2) for printing the ground containing (b) 0.2 to 15 percent by weight of a thickener, (e) 40 to 98 percent by weight of water or an organic solvent, (f) 0 to 5 percent by weight of a binder and (g) 1 to 20 percent by weight of a reservable dye which is a nitro dye of the aniline series; an azo dye of the benzene series; or an anthraquinone, quinoline, pyrazolone, triazole, pyridone or styryl dye which is convertable into the vapour state at 160° to 220° C.;

said non-reservable dye, (c) being devoid of an amino or hydroxyl group capable of reacting with the component (a) at 160° to 220° C. or contains a hydroxyl group, a secondary amino group or a primary amino group, each of which is bound to an aromatic nucleus and is inert to the component (a) the hydroxyl group being capable of forming adjacent carbonyl, azo or nitro groups, a hydrogen bridge with the primary amino group being sterically hindered by a substituent in the o-position and in which the reservable dye (g) contains as a reactive amino or hydroxyl group, capable of reacting with the component (a) at 160° to 220° C. a hydroxyl group or an amino group each bound to an aromatic nucleus, or a secondary amino group present as a member of a pyrazolone, triazole or pyridone ring, the hydroxyl group being free from adjacent carbonyl, azo or nitro groups, and the primary amino group being free from substituents in the o-position, the intermediate carrier is dried, brought into contact with the fibre material to be printed, and both are then subjected to a heat treatment at elevated temperature, optionally with the application of pressure, until the unreserved dyes are transferred from the intermediate carrier to the fibre material, the intermediate carrier being thereupon separated from the printed fibre material.

2. A process according to claim 1, in which the pastes or inks (1) and (2) are printed with a surface deposit in each case of 8 to 25 g/m$^2$ onto the intermediate carrier.

3. A process according to claim 1, in which the thickener (b) is an alginate, an optionally etherified high grade flour, an etherified cellulose or starch, or a homo- or copolymer based on acrylic acid or on maleic anhydride.

4. A process according to claim 1, in which the non-reservable dye (c) is one of the following formulae:

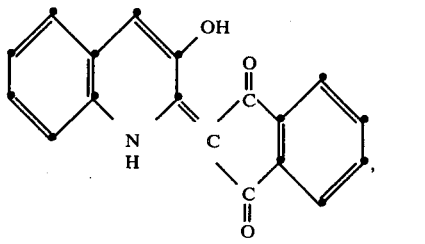

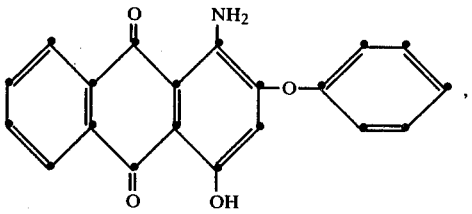

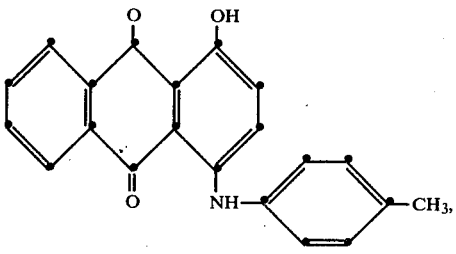

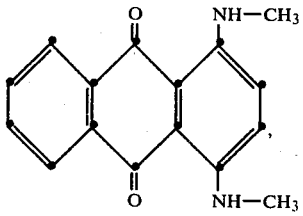

-continued

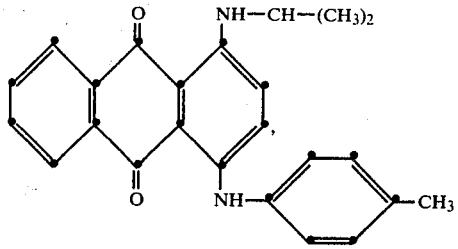

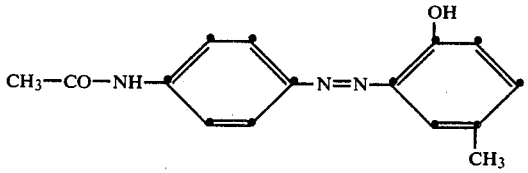

or

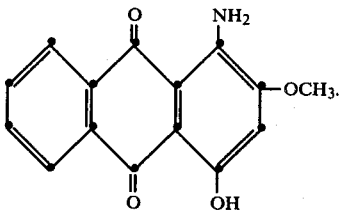

5. A process according to claim 1, in which the reservable dye (g) is one of the following formulae:

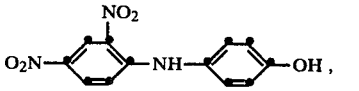

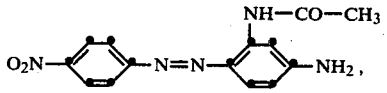

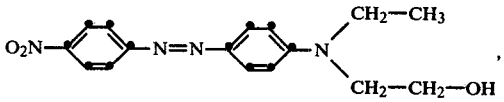

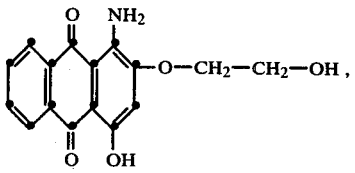

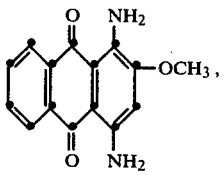

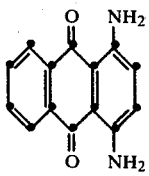

-continued

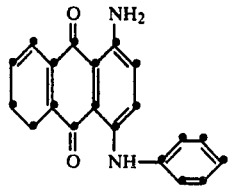

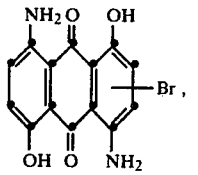

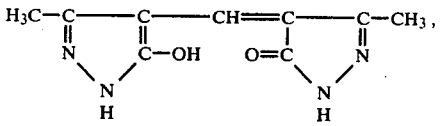

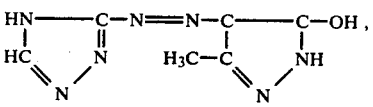

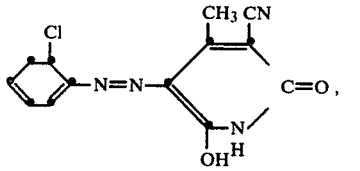

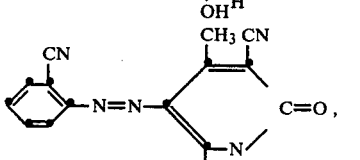

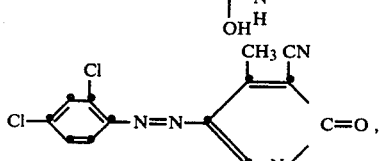

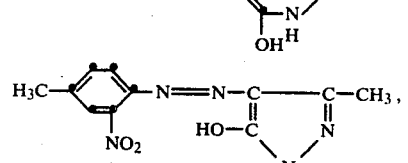

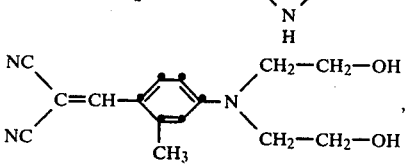

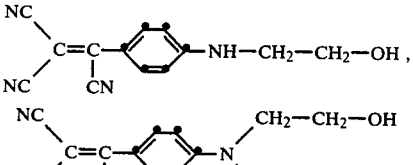

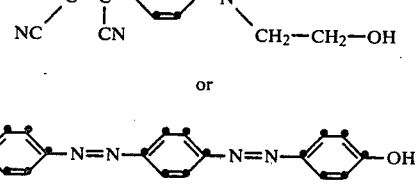

or

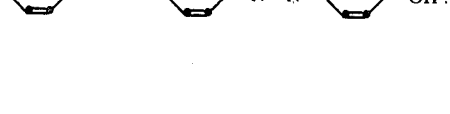

6. A process according to claim 1, in which the curing catalyst (d) is magnesium chloride or 2-amino-2-methyl-1-propanol hydrochloride.

7. A process according to claim 1, in which the organic solvent (e) is an aliphatic alcohol or ketone, or an aromatic hydrocarbon having in each case at most 8 carbon atoms.

8. A process according to claim 1, in which the binder (f) is a polyvinyl alcohol or polyvinyl acetate.

9. A process according to claim 1, in which the synthetic fibre material is polyacrylonitrile, polyamide, polyester, $2\frac{1}{2}$-acetate or triacetate fibres.

10. A process according to claim 1, in which the intermediate carrier is a paper carrier.

11. A process according to claim 1, in which the intermediate carrier is printed, in the rotary printing or gravure printing process, with the printing pastes or inks (1) and (2) in one single operation.

12. A process according to claim 1, in which the intermediate carrier is dried at 80° to 140° C.

13. A process according to claim 1, in which the intermediate carrier is brought into contact with the fibre material, and both are subjected under pressure to a heat treatment at 190° to 220° C. for 20 to 90 seconds.

14. An intermediate carrier for performing the process according to claim 20, which carrier is printed in places with a reserve printing paste or ink (1) containing (a) 10 to 25 percent by weight of a reserving agent which is pentamethylolmelaminetetramethyl ether or hexamethylolmelaminehexamethyl ether, (b) 0.2 to 15 percent by weight of a thickener, (c) 0 to 10 percent by weight of a non-reservable, sublimable disperse dye, which is a nitro-dye of the aniline series; an azo dye of the benzene series; or an anthraquinone, quinoline, pyrazolone, triazole, pyridone or styryl dye, each being convertable to the vapour state at 160° to 220° C., (d) 0 to 2.5 percent by weight of a curing catalyst and (e) 50 to 90 percent by weight of water or an organic solvent and the printing paste or ink (2) for printing the ground containing (b) 0.2 to 15 percent by weight of a thickener, (e) 40 to 98 percent by weight of water or an organic solvent, (f) 0 to 5 percent by weight of a binder and (g) 1 to 20 percent by weight of a reservable dye which is a nitro dye of the aniline series; an azo dye of the benzene series; or an anthraquinone, quinoline, pyrazolone, triazole, pyridone or styryl dye which is convertable into the vapour state at 160° to 220° C.;

said non-reservable dye, (c) being devoid of an amino or hydroxyl group capable of reacting with the component (a) at 160° to 220° C. or contains a hydroxyl group, a secondary amino group or a primary amino group, each of which is bound to an aromatic nucleus and is inert to the component (a) the hydroxyl group being capable of forming adjacent carbonyl, azo or nitro groups, a hydrogen bridge with the primary amino group being sterically hindered by a substituent in the o-position and in which the reservable dye (g) contains as a reactive amino or hydroxyl group, capable of reacting with the component (a) at 160° to 220° C. a hydroxyl group or an amino group each bound to an aromatic nucleus, or a secondary amino group present as a number of a pyrazolone, triazole or pyridone ring, the hydroxyl group being free from adjacent carbonyl, azo or nitro groups, and the primary amino group being free from substituents in the o-position.

* * * * *